US008136905B2

(12) United States Patent
Kneezel et al.

(10) Patent No.: US 8,136,905 B2
(45) Date of Patent: Mar. 20, 2012

(54) DROP VOLUME COMPENSATION FOR INK SUPPLY VARIATION

(75) Inventors: Gary A. Kneezel, Webster, NY (US); R. Winfield Trafton, Brockport, NY (US); Frederick A. Donahue, Walworth, NY (US)

(73) Assignee: Eastman Kodak Company, Rochester, NY (US)

( * ) Notice: Subject to any disclaimer, the term of this patent is extended or adjusted under 35 U.S.C. 154(b) by 347 days.

(21) Appl. No.: 12/146,641

(22) Filed: Jun. 26, 2008

(65) Prior Publication Data

US 2009/0322822 A1 Dec. 31, 2009

(51) Int. Cl.
*B41J 29/38* (2006.01)
*B41J 29/393* (2006.01)

(52) U.S. Cl. ..... 347/17; 347/14; 347/19

(58) Field of Classification Search ..... 347/14, 347/17

See application file for complete search history.

(56) References Cited

U.S. PATENT DOCUMENTS

| | | | | |
|---|---|---|---|---|
| 4,490,728 | A | 12/1984 | Vaught et al. | |
| 5,036,337 | A | 7/1991 | Rezanka | |
| 5,714,990 | A | 2/1998 | Courtney | |
| 5,757,392 | A * | 5/1998 | Zhang | 347/14 |
| 5,949,447 | A | 9/1999 | Arai et al. | |
| 6,517,175 | B2 * | 2/2003 | Kanaya et al. | 347/7 |
| 6,789,883 | B2 * | 9/2004 | Heim et al. | 347/85 |
| 6,811,249 | B2 | 11/2004 | DeVries et al. | |
| 7,040,729 | B2 * | 5/2006 | Richards | 347/7 |
| 7,350,902 | B2 | 4/2008 | Dietl et al. | |
| 2006/0071952 | A1 * | 4/2006 | Motominami et al. | 347/5 |

* cited by examiner

*Primary Examiner* — Omar Rojas
(74) *Attorney, Agent, or Firm* — David A. Novais; Peyton C. Watkins

(57) ABSTRACT

The present invention relates to a method that enables image quality of a printed image to be maintained by reducing unintended variations in drop volume, through the adjustment of ink drop ejecting conditions depending on the amount of ink remaining in an ink tank chamber or reservoir, and/or the ink demand for printing an image. The method of printing of the present invention comprises: providing a printhead in fluid communication with an ink chamber or reservoir; detecting at least one parameter related to an amount of negative pressure provided to the printhead; and adjusting an ink drop ejecting condition of the printhead as a function of the parameter so that an amount of variation in size of ejected ink drop is reduced.

12 Claims, 11 Drawing Sheets

DROP VOLUME COMPENSATION FOR INK SUPPLY VARIATION

CROSS REFERENCE TO RELATED APPLICATIONS

Reference is made to commonly-assigned, U.S. patent application Ser. No. 12/146,484 filed Jun. 26, 2008 entitled METHOD OF PRINTING FOR INCREASED INK EFFICIENCY in the name of Frederick Donahue et al. incorporated herein by reference.

FIELD OF THE INVENTION

The present invention relates generally to the field of inkjet printing, and in particular to a method of printing that provides improved control of drop volume relative to changes in ink supply level and ink demand.

BACKGROUND OF THE INVENTION

Inkjet printing systems include a printhead having an array of drop ejectors that are controlled to eject ink in an imagewise fashion on a printing medium. The quality of the image is determined by factors including tone density uniformity and color rendition that depend somewhat on the volume of the drops of ink that are ejected. If there is excessive variability of the drop volume from one printed image to another, the appearance differences between the images may be objectionable.

It is well known that there are a variety of factors that can influence drop volume. These include drop ejector design, manufacturing variability, physical properties of the ink, temperature of the printhead and ink, pulse waveform for actuating the drop ejector, and drop ejector aging effects. Once a printhead has been designed and an ink has been chosen, the nominal drop volume is determined and the goal becomes one of keeping drop volume variation acceptably low during operation. Generally, drop volume increases with the temperature of the ink, and the modification of the drop ejection actuation waveform or pulse parameters as a function of temperature in order to maintain drop volume approximately constant has been disclosed, for example, in U.S. Pat. No. 5,036,337.

However, there are still other sources of variation in drop volume. Two of these are related to ink supply. As disclosed in U.S. Pat. No. 6,517,175, the drop volume can also be dependent on how much ink remains in the ink reservoir that supplies ink to the printhead, as well as on the ink flow rate for printing that depends on the pattern to be printed. For example, for an ink supply tank containing a porous capillary medium that supplies a negative pressure to the printhead so that ink does not leak out the drop ejector nozzles, a greater negative pressure is provided by the capillary medium when the ink supply tank contains less ink. As a result, the ink meniscus at the nozzles is more concave, so that the ejected drop volume is smaller when there is less ink remaining in the ink tank.

What is needed is a method of printing that compensates for variations in the ink supply, in order to provide a more nearly constant drop volume.

SUMMARY OF THE INVENTION

Accordingly, an object of the present invention is to maintain image quality by reducing unintended variations in drop volume through the adjustment of ink drop ejecting conditions depending on the amount of ink remaining in an ink tank chamber, and/or the ink demand for printing an image.

The present invention therefore relates to a method of printing comprising: providing a printhead in fluid communication with an ink chamber or reservoir; detecting at least one parameter related to an amount of negative pressure provided to the printhead; and adjusting an ink drop ejecting condition of the printhead as a function of the parameter so that an amount of variation in size of ejected ink drop is reduced.

DETAILED DESCRIPTION OF THE INVENTION

Figure 1:
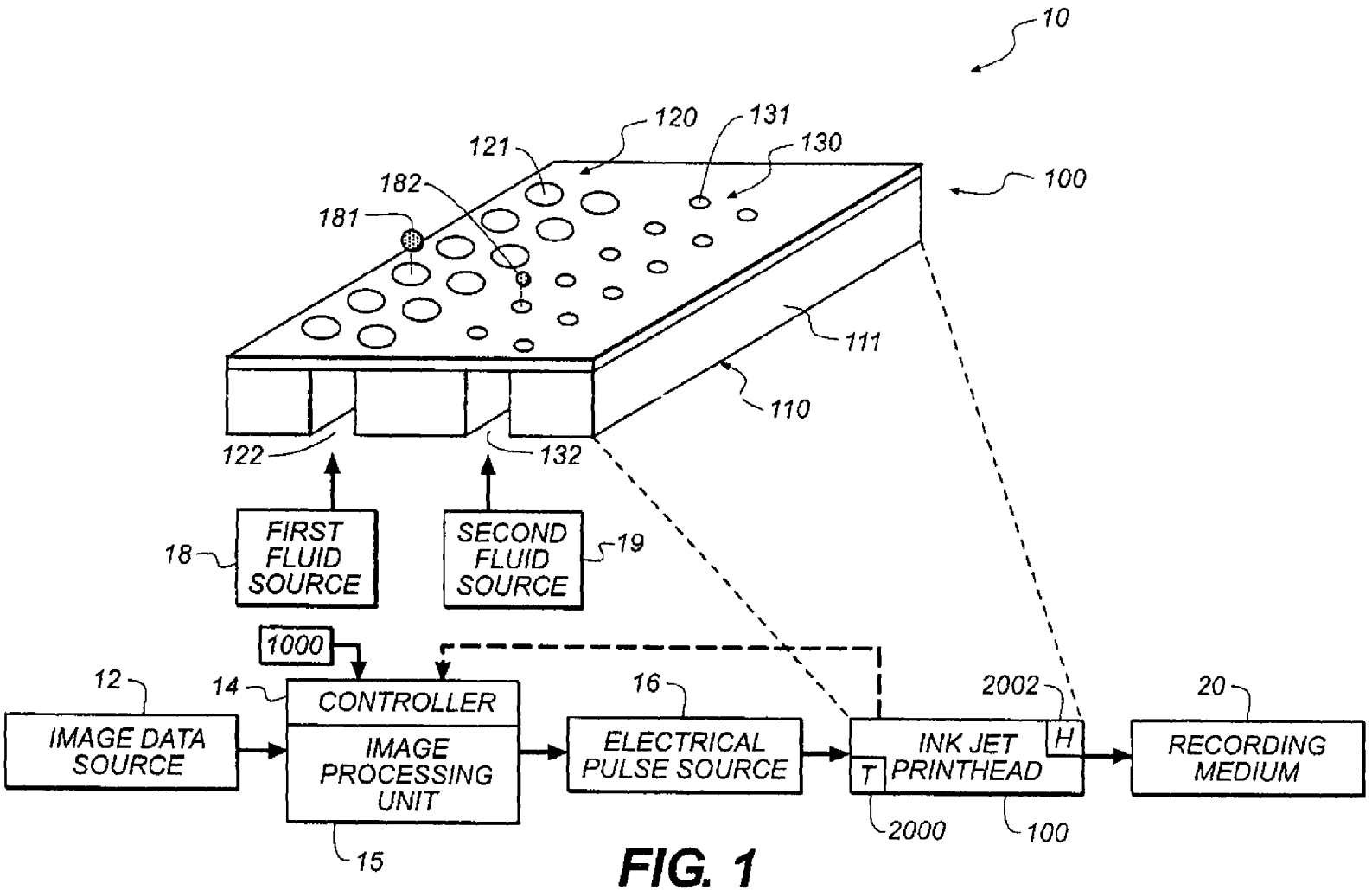
FIG. 1 is a schematic representation of an inkjet printer system.

Referring to FIG. 1, a schematic representation of an inkjet printer system 10 is shown, as described in U.S. Pat. No. 7,350,902. The system includes a source 12 of image data which provides signals that are interpreted by a controller 14 as being commands to eject drops. Controller 14 includes an image processing unit 15 for rendering images for printing, and outputs signals to a source 16 of electrical energy pulses that are inputted to the inkjet printhead 100 which includes at least one printhead die 110. In the example shown in FIG. 1, there are two nozzle arrays. Nozzles 121 in the first nozzle array 120 have a larger opening area than nozzles 131 in the second nozzle array 130. In this example, each of the two nozzle arrays has two staggered rows of nozzles, each row having a nozzle density of 600 per inch. The effective nozzle density then in each array is 1200 per inch. If pixels on the recording medium were sequentially numbered along the paper advance direction, the nozzles from one row of an array would print the odd numbered pixels, while the nozzles from the other row of the array would print the even numbered pixels.

In fluid communication with each nozzle array is a corresponding ink delivery pathway. Ink delivery pathway 122 is in fluid communication with nozzle array 120, and ink delivery pathway 132 is in fluid communication with nozzle array 130. Portions of fluid delivery pathways 122 and 132 are shown in FIG. 1 as openings through printhead die substrate 111. One or more printhead die 110 will be included in inkjet printhead 100, but only one printhead die 110 is shown in FIG. 1. The printhead die are arranged on a support member as discussed below relative to FIG. 2. In FIG. 1, first ink source 18 supplies ink to first nozzle array 120 via ink delivery pathway 122, and second ink source 19 supplies ink to second nozzle array 130 via ink delivery pathway 132. Although distinct ink sources 18 and 19 are shown, in some applications it may be beneficial to have a single ink source supplying ink to nozzle arrays 120 and 130 via ink delivery pathways 122 and 132 respectively. Also, in some embodiments, fewer than two or more than two nozzle arrays may be included on printhead die 110. In some embodiments, all nozzles on a printhead die 110 may be the same size, rather than having multiple sized nozzles on a printhead die.

Not shown in FIG. 1 are the drop forming mechanisms associated with the nozzles. Drop forming mechanisms can be of a variety of types, some of which include a heating element to vaporize a portion of ink and thereby cause ejection of a droplet, or a piezoelectric transducer to constrict the volume of a drop ejector chamber and thereby cause ejection, or an actuator which is made to move (for example, by heating a bilayer element) and thereby cause ejection. In any case, electrical pulses from pulse source 16 are sent to the various drop ejectors according to the desired deposition pattern. In the example of FIG. 1, droplets 181 ejected from nozzle array 120 are larger than droplets 182 ejected from nozzle array 130, due to the larger nozzle opening area. Typically other aspects of the drop forming mechanisms (not shown) associated respectively with nozzle arrays 120 and 130 are also sized differently in order to optimize the drop ejection process for the different sized drops. During operation, droplets of ink are deposited on a recording medium 20.

Figure 2:
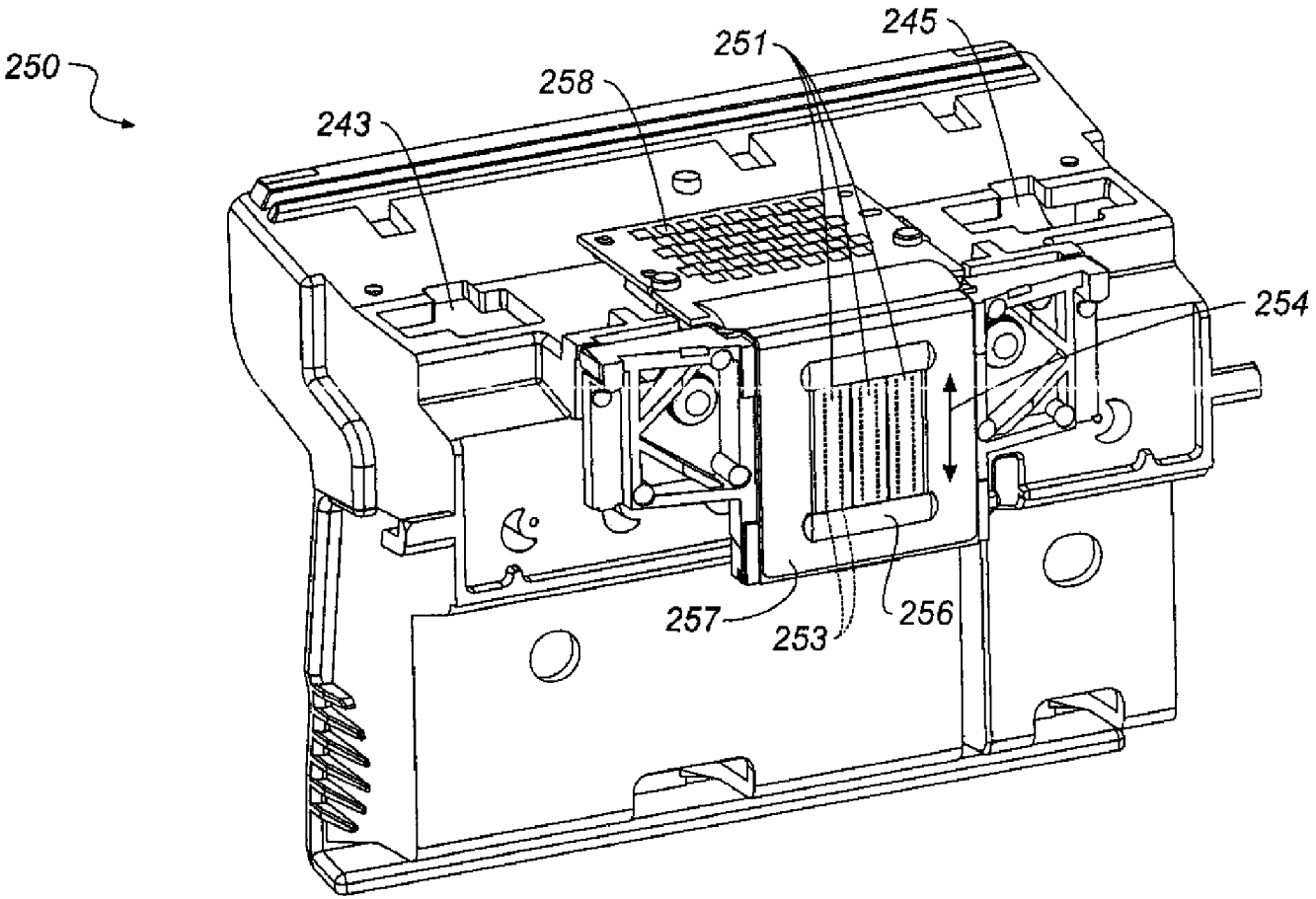
FIG. 2 is a perspective view of a portion of a printhead.

FIG. 2 shows a perspective view of a portion of a printhead chassis 250, which is an example of an inkjet printhead 100. Printhead chassis 250 includes three printhead die 251 (similar to printhead die 110), each printhead die containing two nozzle arrays 253, so that printhead chassis 250 contains six nozzle arrays 253 altogether. The six nozzle arrays 253 in this example may be each connected to separate ink sources (not shown in FIG. 2), such as cyan, magenta, yellow, text black, photo black, and a colorless protective printing fluid. Each of the six nozzle arrays 253 is disposed along direction 254, and the length of each nozzle array along direction 254 is typically on the order of 1 inch or less. Typical lengths of recording media are 6 inches for photographic prints (4 inches by 6 inches), or 11 inches for 8.5 by 11 inch paper. Thus, in order to print the full image, a number of swaths are successively printed while moving printhead chassis 250 across the recording medium. Following the printing of a swath, the recording medium is advanced. The advance distance for single pass printing would be approximately $1_n$. For N-pass multipass printing, the advance distance for the recording medium would be approximately $1_n/N$. The total number of passes to print a sheet of recording media is thus approximately equal to $NL/1_n$. While a larger number N usually provides better print quality (because multiple nozzles are responsible for printing pixels within a line, so that defects due to malfunctioning nozzles are hidden), multipass printing also requires more total passes, so that printing throughput is reduced.

Also shown in FIG. 2 is a flex circuit 257 to which the printhead die 251 are electrically interconnected, for example by wire bonding or TAB bonding. The interconnections are covered by an encapsulant 256 to protect them. Flex circuit 257 bends around the side of printhead chassis 250 and connects to connector board 258. When printhead chassis 250 is mounted into the carriage 200 (see FIG. 3), connector board 258 is electrically connected to a connector (not shown) on the carriage 200, so that electrical signals may be transmitted to the printhead die 251.

Figure 3:
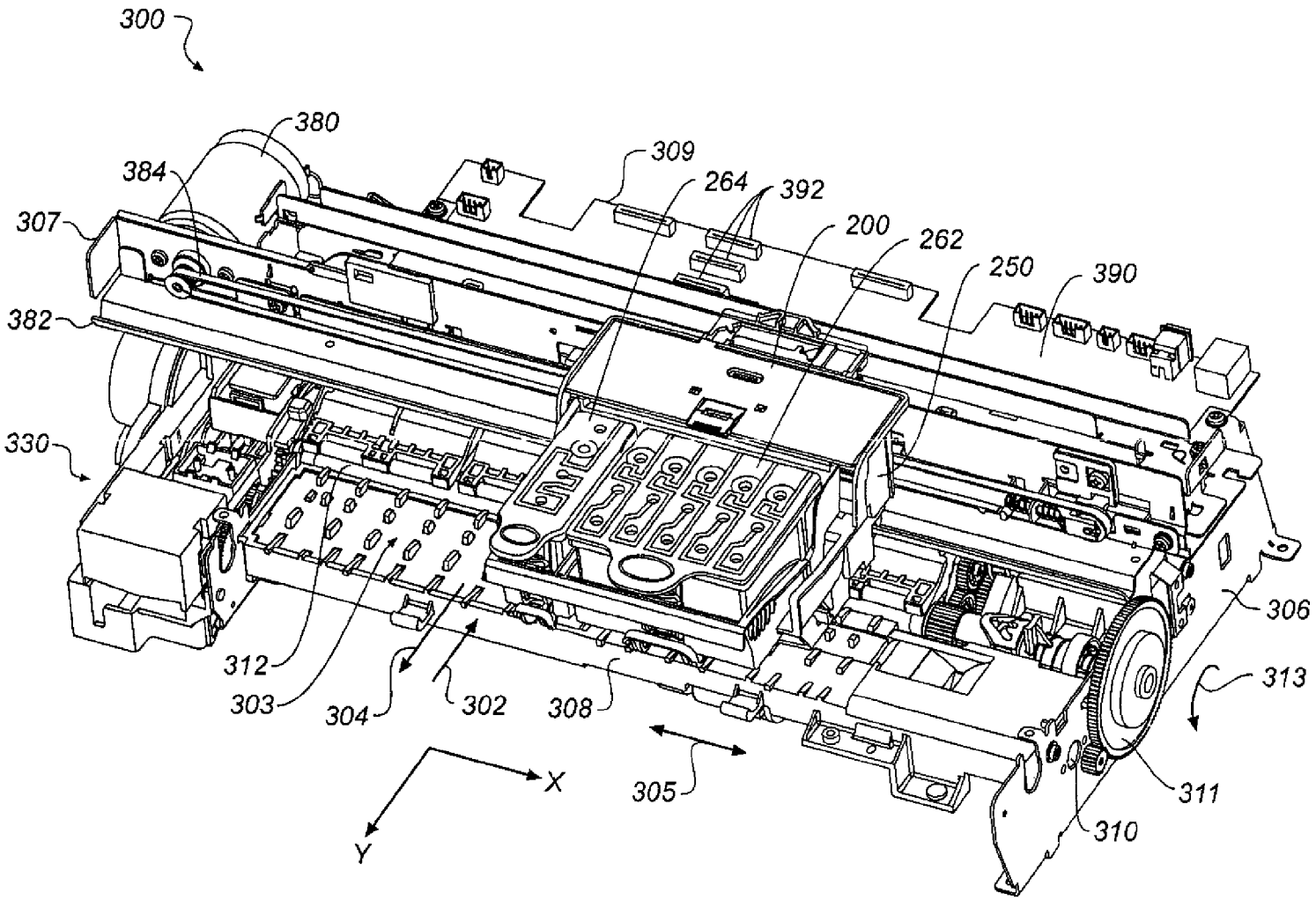
FIG. 3 is a perspective view of a portion of a carriage printer.

FIG. 3 shows a portion of a carriage printer. Some of the parts of the printer have been hidden in the view shown in FIG. 3 so that other parts may be more clearly seen. Printer chassis 300 has a print region 303 across which carriage 200 is moved back and forth 305 along the X axis between the right side 306 and the left side 307 of printer chassis 300 while printing. Carriage motor 380 moves belt 384 to move carriage 200 back and forth along carriage guide rail 382. Printhead chassis 250 is mounted in carriage 200, and ink supplies 262 and 264 are mounted in the printhead chassis 250.

The mounting orientation of printhead chassis 250 is rotated relative to the view in FIG. 2, so that the printhead die 251 are located at the bottom side of printhead chassis 250, the droplets of ink being ejected downward onto the recording media in print region 303 in the view of FIG. 3. Ink supply 262, in this example, contains five ink sources—cyan, magenta, yellow, photo black, and colorless protective fluid, while ink supply 264 contains the ink source for text black. Paper, or other recording media (sometimes generically referred to as paper herein) is loaded along paper load entry direction 302 toward the front 308 of printer chassis 300.

A variety of rollers are used to advance the medium through the printer. For example, a pickup roller moves the top sheet of a stack of paper or other recording media in the direction of arrow 302. A turn roller toward the rear 309 of the printer chassis 300 acts to move the paper around a C-shaped path (in cooperation with a curved rear wall surface) so that the paper continues to advance along direction arrow 304 from the rear 309 of the printer. The paper is then moved by feed roller 312 and idler roller(s) to advance along the Y axis across print region 303, and from there to a discharge roller and star wheel(s) so that printed paper exits along direction 304. Feed roller 312 includes a feed roller shaft along its axis, and feed roller gear 311 is mounted on the feed roller shaft. The motor that powers the paper advance rollers is not shown in FIG. 1, but the hole 310 at the right side 306 of the printer chassis 300 is where the motor gear (not shown) protrudes through in order to engage feed roller gear 311, as well as the gear for the discharge roller (not shown). For normal paper pick-up and feeding, it is desired that all rollers rotate in forward direction 313. Toward the left side 307 in the example of FIG. 3 is the maintenance station 330. Toward the rear 309 of the printer in this example is located the electronics board 390, which contains cable connectors 392 for communicating via cables (not shown) to the printhead carriage 200 and from there to the printhead. Also on the electronics board are typically mounted motor controllers for the carriage motor 380 and for the paper advance motor, a processor and/or other control electronics for controlling the printing process, and an optional connector for a cable to a host computer.

Figure 4:
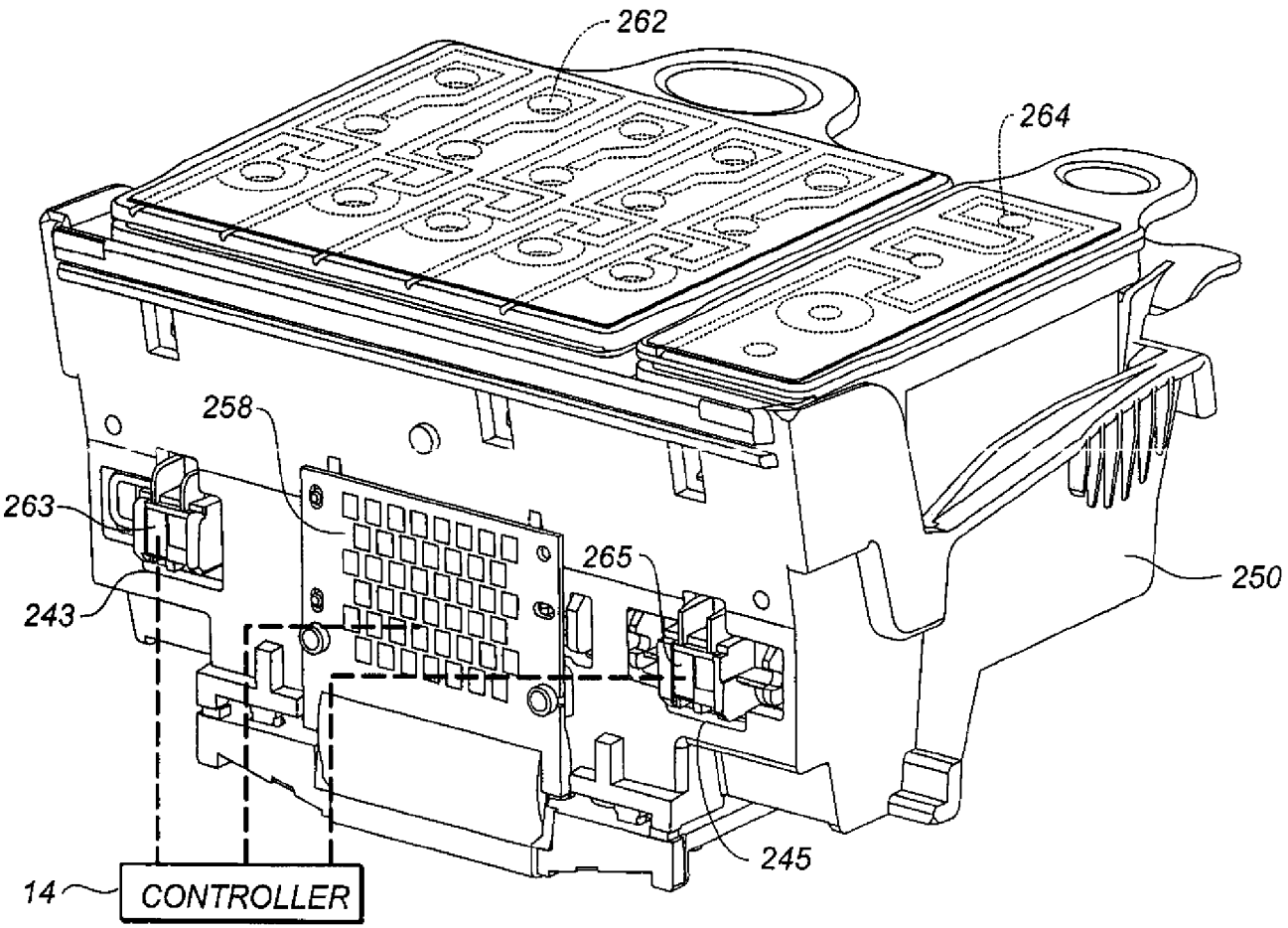
FIG. 4 is a perspective view of a portion of a printhead rotated relative to FIG. 2.

FIG. 4 shows a perspective view of printhead chassis 250 that is rotated relative to the view in FIG. 2. Replaceable ink tanks (multichamber ink tank 262 and single chamber ink tank 264) are shown mounted in printhead chassis 250. Multichamber ink tank 262 includes a memory device 263 and single chamber ink tanks 264 includes a memory device 265. The memory devices 263 and 264 are typically used to provide information to controller 14 of the printer, and also to store data regarding the amount of ink that has been used from each chamber of the ink tank. Memory devices 263 and 265 protrude through holes 243 and 245 respectively in printhead chassis 250. In this way, contact pads on memory devices 263 and 265 and connector board 258 may easily be contacted by a connector in carriage 200, and from there through cables to cable connectors 392 on electronics board 390.

Figure 5:
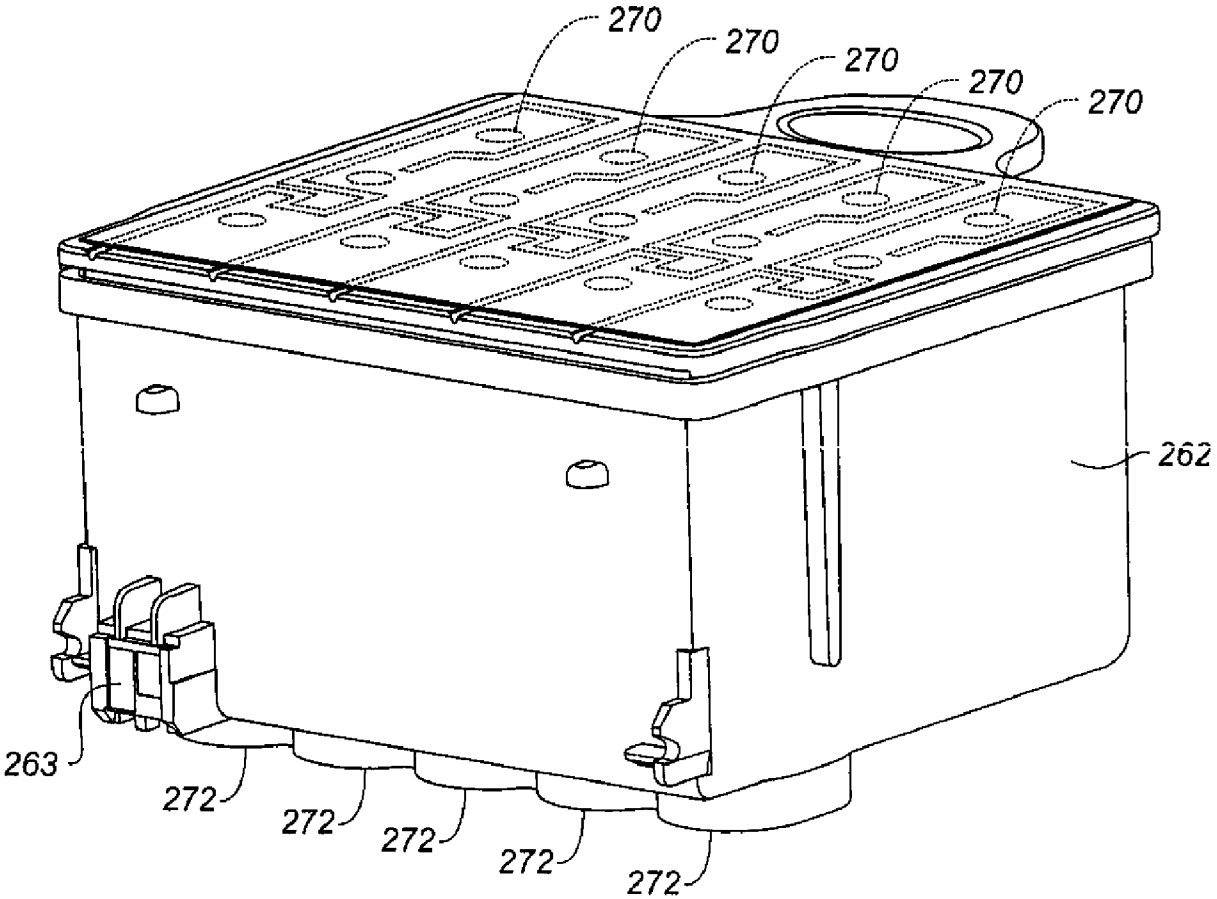
FIG. 5 is a perspective view of a multichamber ink tank.

FIG. 5 shows a perspective view of multichamber ink tank 262 removed from printhead chassis 250. In this example, multichamber ink tank 262 has five chambers 270, and each chamber has a corresponding ink tank port 272 that is used to transfer ink to the printhead die 251.

Figure 6:
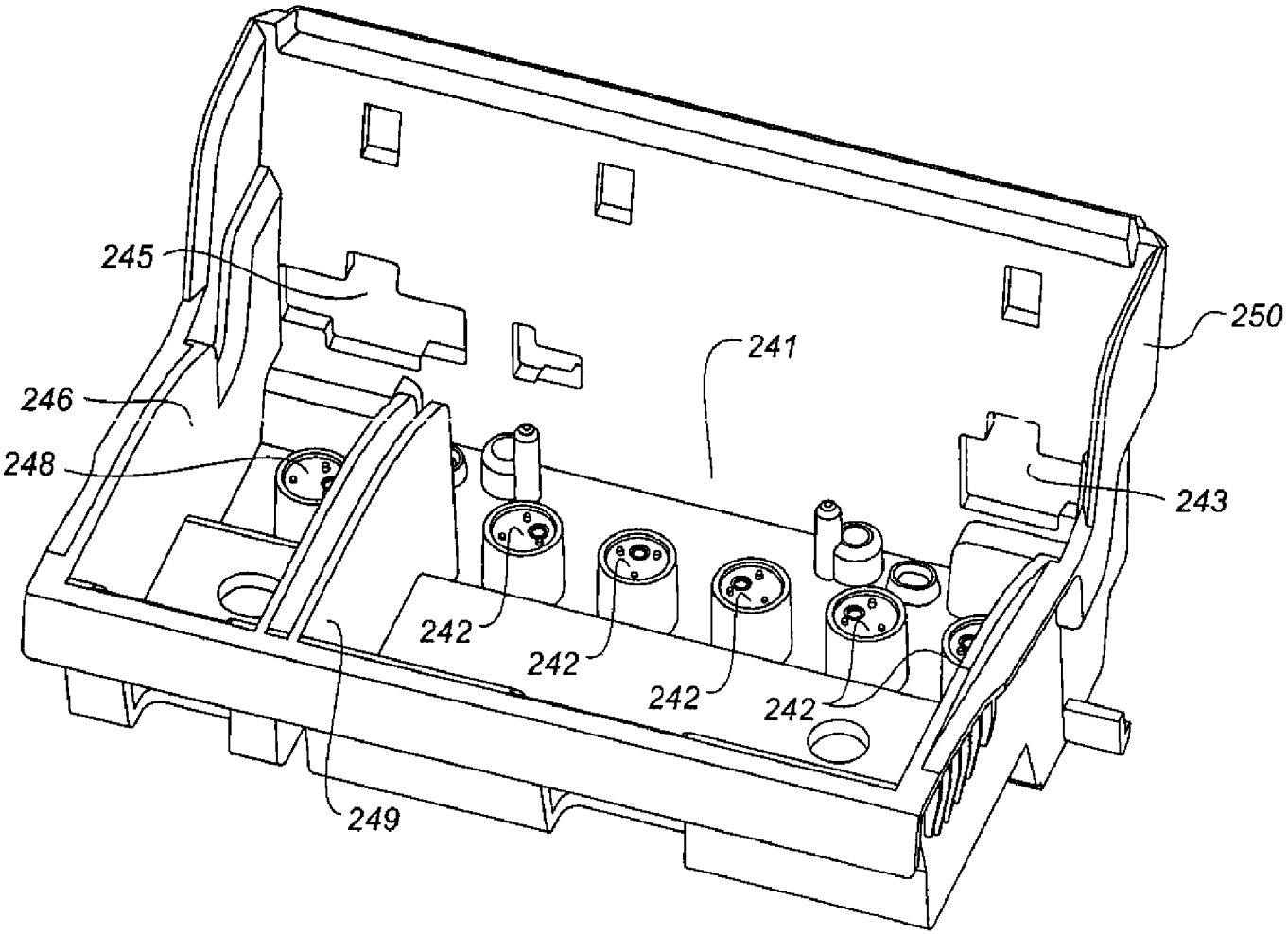
FIG. 6 is a perspective view of a portion of a printhead chassis with ink tanks removed.

FIG. 6 shows a perspective view of printhead chassis without either replaceable ink tank 262 or 264 mounted in it. Multichamber ink tank 262 is mountable in a region 241 and single chamber ink tank 264 is mountable in region 246 of printhead chassis 250. Region 241 is separated from region 246 by partitioning wall 249, which may also help guide the ink tanks during installation. Five ports 242 are shown in region 241 that connect with ink tank ports 272 of multichamber ink tank 262 when it is installed, and one port 248 is shown in region 246 for the ink tank port on the single chamber ink tank 264. The term ink reservoir will also be used herein interchangeably with ink tank. When an ink reservoir is installed in the printhead chassis 250, it is in fluid communication with the printhead because of the connection of ink tank port 272 with port 242 or 248.

Figure 7:
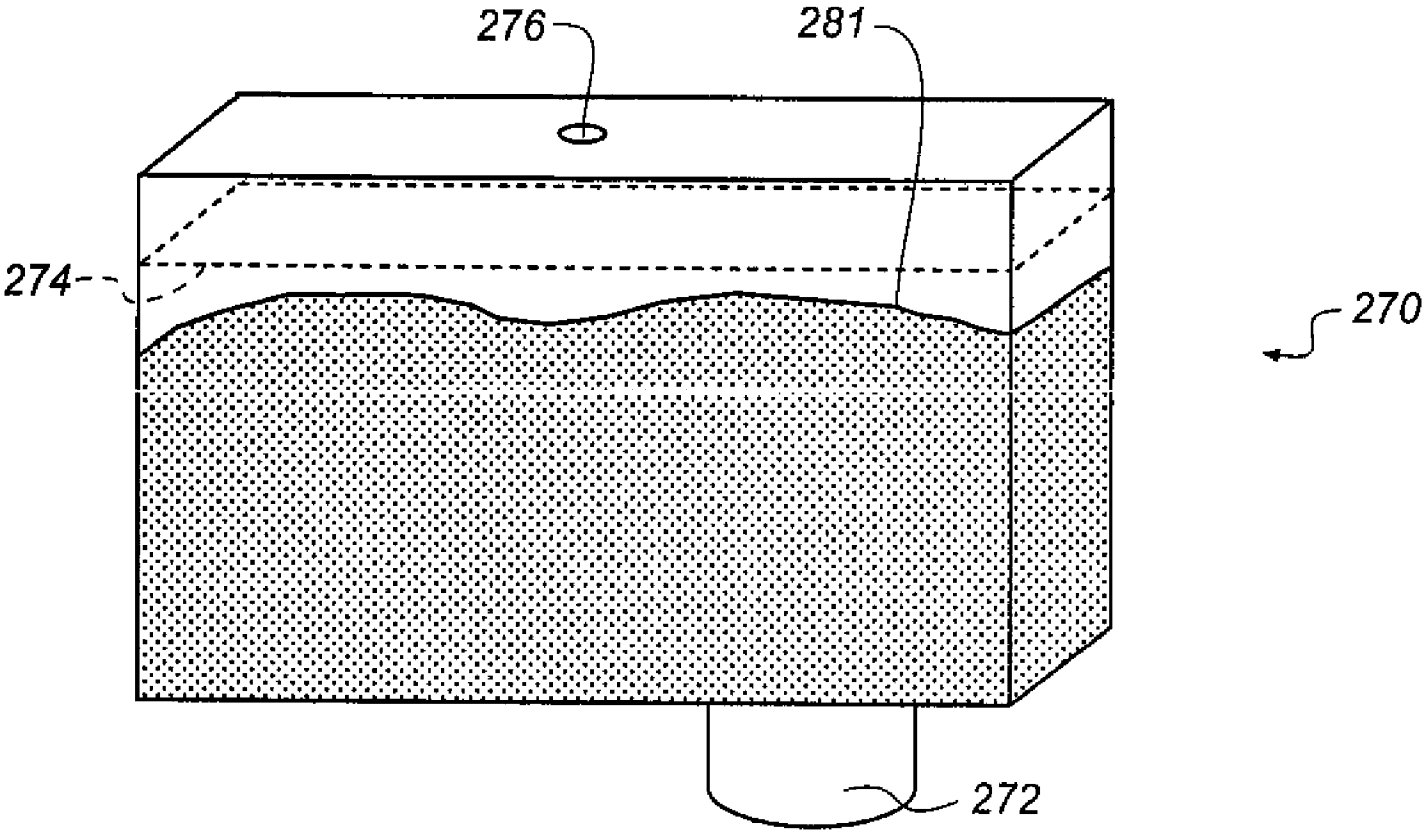
FIG. 7 is a schematic representation of an ink tank chamber having a porous medium that is nearly full of ink.

FIG. 7 shows a schematic representation of an ink tank chamber or reservoir 270 that is nearly filled with a porous capillary medium 274 that is saturated with ink in region 281, such that the chamber contains nearly its full level of ink. Porous medium 274 may include materials such as foam, felt, stacked beads, or other such media having interstitial spaces into which fluid may be drawn by surface tension. When an ink tank containing chamber 270 is installed in printhead chassis 250 such that tank port 272 contacts a port 242 or 248, ink from chamber 270 may be drawn into the printhead chassis and to the corresponding printhead die 251. Optionally, upon installation, suction is applied at the face of printhead die 251 in order to start the flow and remove air bubbles that may have entered the printhead chassis prior to ink tank installation. Once a column of ink is established between the printhead die and the porous media 274, capillary forces in the porous media establish a negative pressure that forms a concave meniscus at the nozzles in corresponding nozzle array 253. The negative pressure is dependent upon the ink fill level in tank chamber 270. A tank chamber that is nearly empty of ink exerts a more highly negative pressure than a nearly full tank chamber does.

As ink is drawn from tank chamber 270 through tank port 272 due to printing or printhead maintenance operations, air enters a vent 276. Vent 276 is shown simply as a hole in the lid of the tank chamber 272, but typically the vent will include a winding path that will let air pass, but inhibits evaporation as well as liquid ink from leaking out of the tank chamber.

Figure 8:
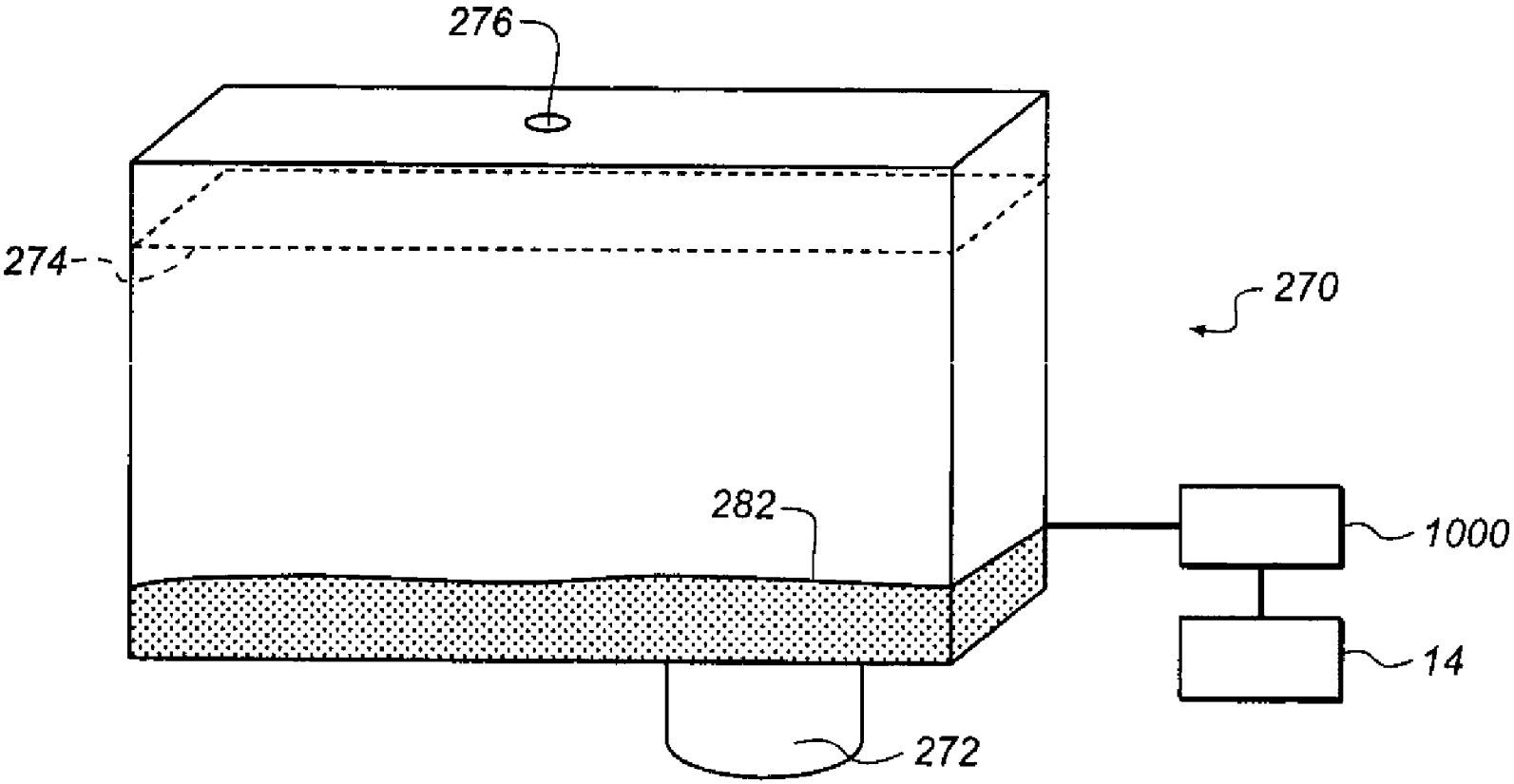
FIG. 8 is a schematic representation of an ink tank chamber that has been substantially uniformly depleted of ink.

FIG. 8 is a schematic representation of an ink tank chamber or reservoir 272 where the ink has nearly been depleted from porous medium 274, such that region 282 of porous medium 274 that is saturated with ink is near the bottom of the tank chamber 270 where tank port 272 is located. FIG. 8 shows a schematic representation of an ink tank similar to FIG. 7, but in which the ink has been substantially depleted from porous medium.

There are a variety of methods known in the art for monitoring the amount of ink that remains in an ink tank chamber. Some of these methods use sensors schematically shown by reference numeral 1000 in FIGS. 1 and 8 to measure the ink level in the tank chamber. Such sensors can include optical sensors that detect an optical characteristic of a transparent wall of the tank chamber, for example, that depends upon whether ink is present up to a certain level in the tank chamber. Other types of sensors include electrically resistive sensors in contact with a partially conductive ink, or capacitive sensors that sense a change in the capacitance with ink level. Other types of sensors involve a mechanical motion based on an amount of free ink in the tank chamber—for example by a float on the free ink, or by movement of a flexible tank chamber wall.

Indirect methods for monitoring the amount of ink remaining in a tank chamber have also been described. Such methods can involve counting of the drops that have been ejected for printing, and multiplying the number of drops by the drop volume. Such methods also may include counting the number of maintenance operations on the printhead that have occurred, and multiplying by the volume of ink required for the corresponding types of maintenance operations. Because it is known how much ink was put into the ink tank chamber during a filling operation, if the calculated amount of ink that has been used is subtracted from the original fill amount, an indication of the remaining ink is provided. For the purpose of this description, sensor 1000 is understood to refer to such indirect methods, or alternatively to a physical sensor as described in the paragraph above. The amount of ink that has been used (or correspondingly the amount of ink that remains) is sometimes stored in a memory device, such as 263 or 265 in FIGS. 4 and 5. The memory device may be mounted on the ink tank, so that even if the ink tank is removed from the printer and then reinserted, the printer controller 14 will recognize the ink tank and how much ink it contains in each tank chamber.

U.S. Pat. No. 6,517,175 considers how to improve the accuracy of drop counting for tracking the amount of ink remaining in the tank chamber. U.S. Pat. No. 6,517,175 recognizes that the drop volume ejected from a nozzle depends upon various operating conditions, including ink temperature, the amount of ink remaining in the tank chamber, the frequency of drop ejection, and the electrical pulse waveform provided to the drop ejector. It is well known that as ink temperature increases, the volume of the ejected drop increases. This can be attributed to lower ink viscosity. (In the case of thermal inkjet, not discussed in U.S. Pat. No. 6,517,175, a drop volume increase with temperature can also be attributed to the increased thermal energy content of the ink prior to bubble nucleation.) The effect on drop volume due to the amount of ink in the ink tank chamber is related to the amount of negative pressure exerted by the pressure regulating mechanism. For pressure regulation provided by a porous medium in the ink tank chamber, a greater amount of negative pressure is provided as the tank chamber is depleted. As a result, the drop ejector is less completely filled with ink at the time of ejection, so that the drop volume is lower for a nearly empty ink tank chamber than it is for a nearly full ink tank chamber operating under otherwise identical operating conditions.

Frequency of drop ejection can have an effect on drop volume, in that the drop ejector for a given nozzle may not have time to refill completely for high frequency drop ejection, and cross-talk due to firing of adjacent drop ejectors can also have an effect. Finally, the drop volume can be affected by the waveform of the pulse applied to the drop ejector. As noted in U.S. Pat. No. 6,517,175, for piezoelectric drop ejectors it is possible to provide various sizes of drops (e.g. for large, medium and small dots) for various pixel locations in order to produce the desired image tones. U.S. Pat. No. 6,517,175 discloses storing a set of correction factors related to ink temperature, amount of ink remaining in the tank chamber, and the dot pattern to be printed (related to drop ejection frequency and duty cycle). As disclosed in U.S. Pat. No. 6,517,175, the nominal quantity of each drop (large, medium, or small) can be corrected by the appropriate correction factor values depending on operating conditions, so that a more accurate drop counting estimate of the amount of ink ejected during printing is provided.

An object of the present invention is to maintain image quality by reducing unintended variations in the drop volume through adjusting the ink drop ejecting conditions depending on a) the amount of ink remaining in an ink tank chamber, and/or b) the ink demand for printing an image. Both conditions a) and b) relate to the amount of negative pressure that is provided at the inkjet nozzles. With regard to condition a), a nearly empty ink tank chamber provides more negative pressure than a nearly full ink tank chamber due to increased capillary forces exerted by the nearly empty porous medium. With regard to condition b), the ink impedance of the fluid pathway between the ink reservoir and the printhead nozzles results in a larger pressure drop when a high flow rate is required than when a low flow rate is required.

Figure 9:
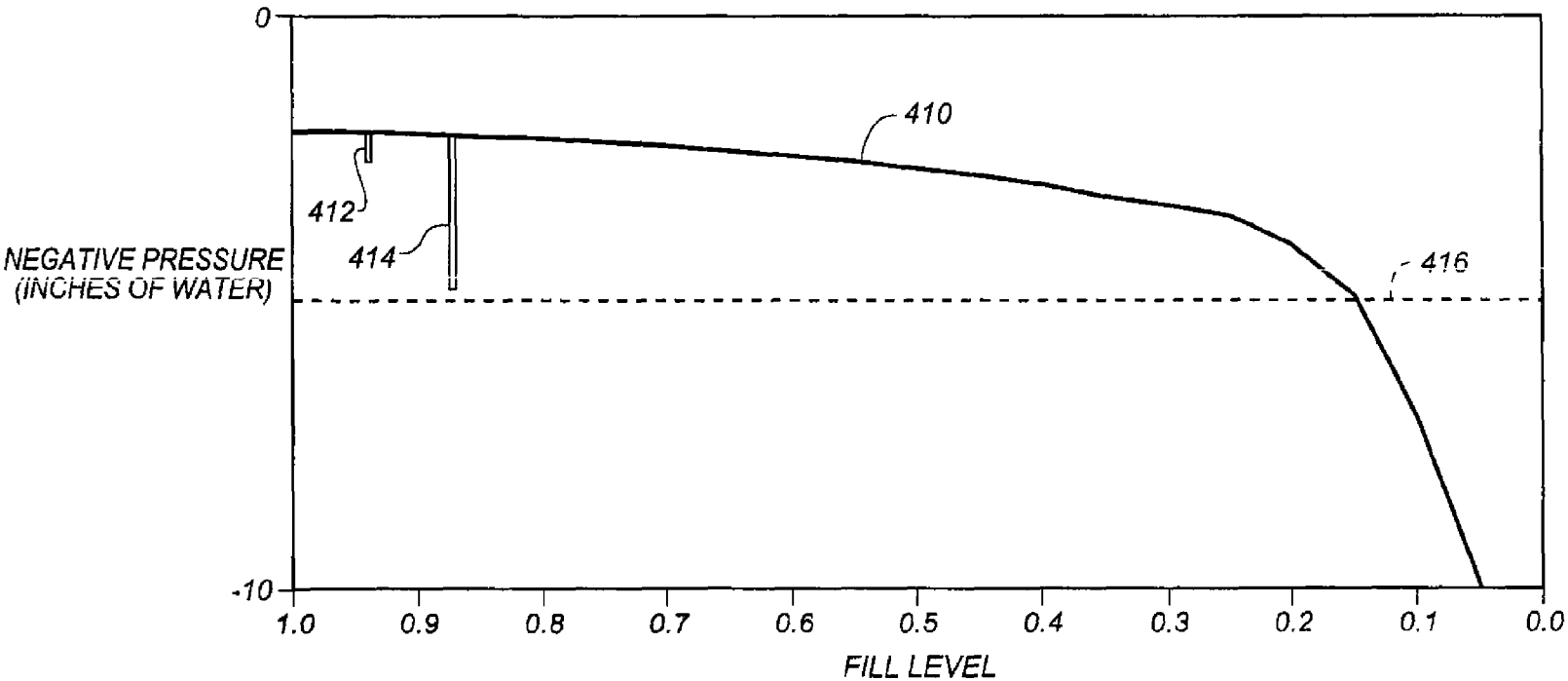
FIG. 9 is a schematic representation of the effect of ink chamber fill level and flow rate on negative pressure.

FIG. 9 schematically shows the effects of both conditions a) and b). Curve 410 shows an example of the static negative pressure versus ink fill level, where 1 corresponds to a full tank chamber and 0 corresponds to an empty tank chamber. In this particular example, the negative pressure starts out at −2 inches of water for a full tank chamber and goes to −10 inches of water for an empty tank chamber. If there is an ink flow, there is an additional pressure drop relative to the static negative pressure level at zero flow. Pressure drop 412 corresponds to a relatively small flow rate, as might occur for a text document that is being printed, while pressure drop 414 corresponds to a higher flow rate, as might occur for a higher density image such as a photo. In some embodiments it is found that jetting is not well controlled at too large a negative pressure (for example, due to ink starvation within the printhead), and a static negative pressure level 416 is chosen for a cut-off level where ink will no longer be supplied, because for a large pressure drop (such as 414) occurring at negative pressure level 416, the total negative pressure would be too large for proper jetting behavior. The fill level at which the tank would no longer be used corresponds to the intersection of curve 410 and level 416, i.e. the point at which the ink tank chamber is at 15% full in this example.

Figure 10:
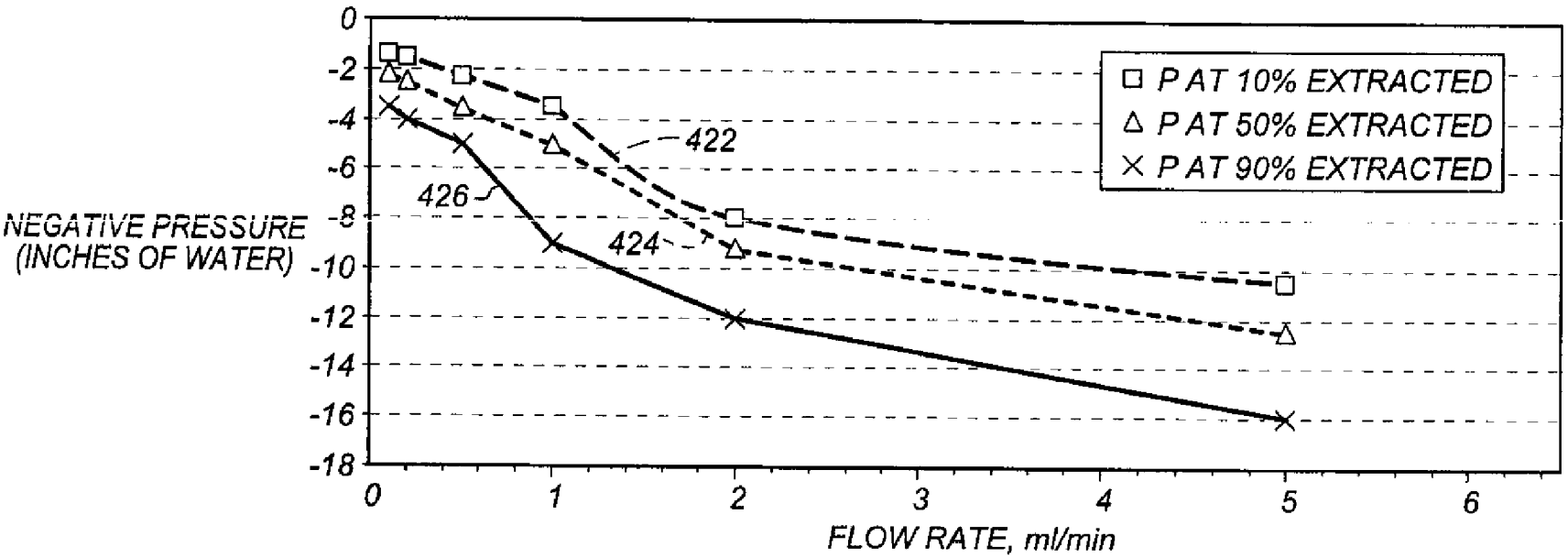
FIG. 10 is a plot of exemplary data of negative pressure versus flow rate from an ink tank chamber for various ink fill levels.

FIG. 10 shows exemplary data of negative pressure versus flow rate from an ink tank chamber for various ink fill levels. Curve 422 shows the negative pressure versus flow rate for 10% of the ink extracted (i.e. 90% fill level), curve 424 shows negative pressure versus flow rate for 50% of the ink extracted, and curve 426 shows negative pressure versus flow rate for 90% of the ink extracted (i.e. 10% fill level).

The flow rate during printing is the drop ejection frequency times the drop volume times the number of jets times the duty cycle of firing. For a printhead having a nozzle array 120 with 640 nozzles that are ejecting drops of 6 picoliter volume at a drop ejection frequency of 30 kHz at 100% duty cycle, the ink flow rate is 0.115 ml/second or 6.9 ml/minute. The duty cycle for firing is based on both the image to be printed and also the print mode. Many images do not include extensive regions of 100% pixel density where all nozzles in the printhead would need to be fired. In addition, high quality printing is typically done in a multipass mode. For N pass printing, the print mask density is 1/N on the average. Thus, in the example of printing 6 picoliter drops from 640 jets at full tone density at 30 KHz, although single pass printing would result in a flow rate of 6.9 ml/minute, seven pass printing (as might be used for a high quality photo) would only result in an average flow rate of 1.0 ml/minute from the ink tank chamber, even at 100% tone density. For a nozzle array 130 having a smaller drop volume of 3 picoliters, the seven pass full tone density printing would result in half the flow rate (0.5 ml/minute) as the 6 picoliter example.

It can be seen from FIG. 10 that at a flow rate of 0.5 ml/minute, the negative pressure differential due to flow rate (the level at a flow rate 0.5 ml/minute as compared to the static negative pressure at zero flow rate) is on the order of 1 inch of water for a tank that is 90% full (curve 422) and is on the order of 1.5 to 2 inches of water for a tank chamber that is 50% full (curve 424) or 10% full (curve 426). Again from FIG. 10, at a flow rate of 1.0 ml/minute, the negative pressure differential due to flow rate is on the order of 2 inches of water for a 90% full tank chamber, 3 inches of water for a 50% full tank chamber, and 6 inches of water for a 10% full tank chamber. Thus it is evident that for high density images printed in a mode having relatively fewer number of passes, large drop volume and high drop ejection frequency, the pressure drop due to flow rate from ink demand in printing can be substantial.

U.S. Pat. No. 5,714,990 discloses a method of determining image density of a portion of an image to be printed in a swath, but other methods can be employed alternatively. A motivation for determining image density in U.S. Pat. No. 5,714,990 is to provide sufficient drying time for a highly inked printed image.

Image data from image data source 12 is processed by image processing unit 15 to specify a) the appropriate amount of ink to deposit at particular pixel locations of the image, b) the number of passes needed to lay the ink down on the media, and c) the type of pattern required on each pass in order to produce the image. In an embodiment of the present invention, the processed image data for the image to be printed is analyzed by controller 14, e.g. by counting the drops that are to be jetted at a given rate in a portion of the image in order to calculate an ink flow demand required for printing the portion of the image. Such calculations can be done in the processing unit of controller 14 as instructed by printer firmware. In addition, the remaining ink in an ink tank chamber is monitored using, for example, the previously described sensors or monitors 1000. As schematically shown in FIGS. 1 and 8, the amount of remaining ink in the ink tank chamber can be determined by sensor 1000, and a signal indicative thereof is provided to controller 14. Controller 14 is therefore enabled to adjust drop ejecting conditions accordingly in order to maintain a more nearly constant drop volume, and thereby maintain image quality. In particular, as the tank is depleted of ink or relatively high printing ink flow rates are required (tending to lead a drop volume that is smaller than nominal), the printhead die temperature and/or the pulsing waveform (as controlled by electrical pulse source 16) for ejecting a drop are modified to increase the drop size back to nominal.

Figure 11:
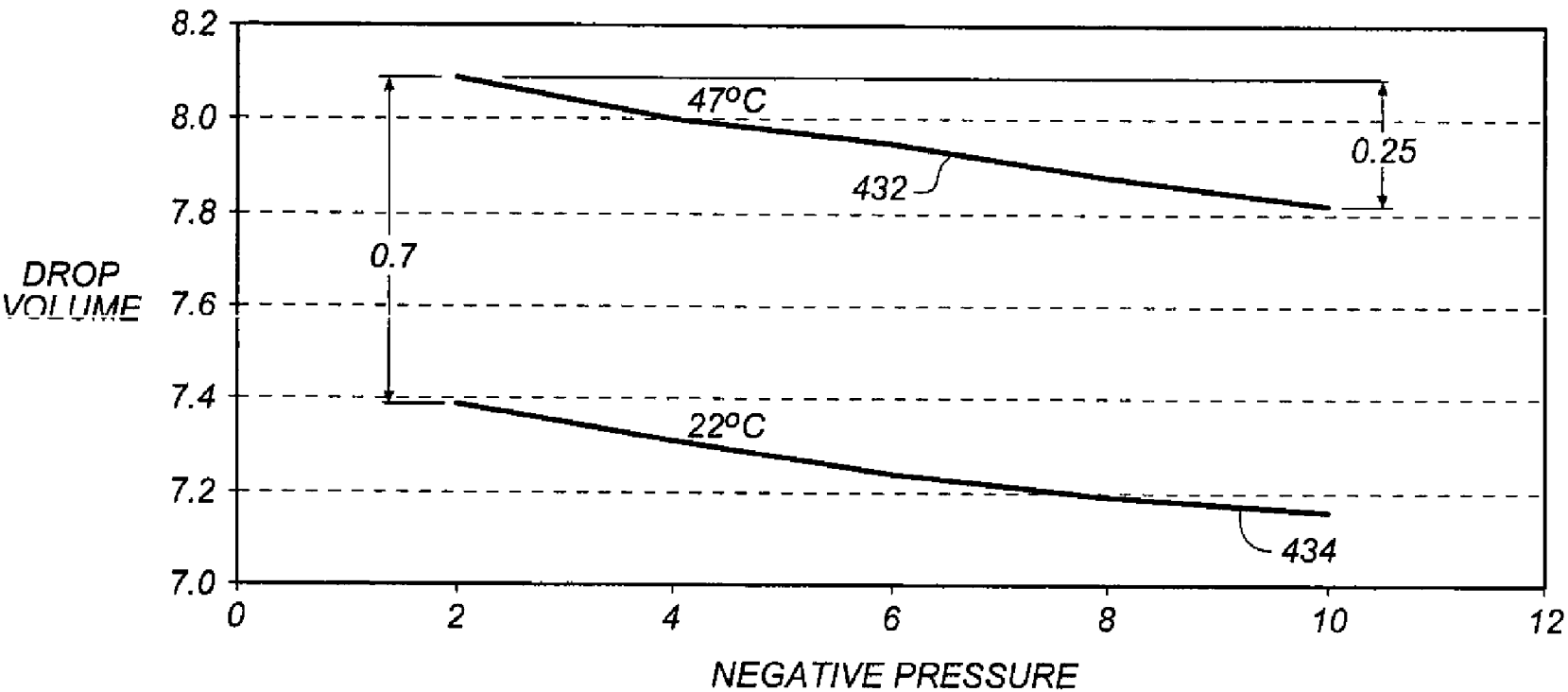
FIG. 11 is a plot of exemplary data of drop volume versus the amount of negative pressure at two different temperatures.

FIG. 11 is a plot of exemplary data showing the drop volume versus negative pressure at two different temperatures for a thermal inkjet printhead nozzle array in which the pulsing waveform was kept constant. Curve 432 represents data for a printhead die temperature of 47° C., while curve 434 represents data for the same printhead die at a temperature of 22° C. Printhead die temperature was measured using a temperature sensor 2000 (FIG. 1) fabricated on die substrate 111. Temperature sensor 2000 is adapted to at least supply a signal to controller 14 indicative of the printhead temperature. Because ink is in close contact with the substrate 111, and because in this example the substrate is made of silicon having excellent thermal conductivity, the printhead die temperature provides a good approximation of the temperature of the ink that resides in the various passageways within the printhead die 110 or 251. Curve 432 is offset from curve 434 by an approximately uniform amount of 0.7 picoliter. In other words, for the same pulsing waveform, as the temperature increased by 25° C. from 22° C. to 47° C., the drop volume increased by about 10%. Also, for both curves 432 and 434, as the magnitude of negative pressure increased from 2 to 10 inches of water, the drop volume decreased by about 0.25 picoliter, or about by 3%.

The data of FIG. 11 makes it evident that if the operating temperature of the printhead die 251 can be higher for an ink tank chamber 270 when it provides a highly negative pressure (due to low fill level and/or high flow rate) than it is for the ink tank chamber 270 when it provides a low negative pressure (due to high fill level and/or low flow rate), then the drop volume can be adjusted back to its nominal value. The nominal value is the target drop volume determined in the design of the writing system. In some systems the nominal value may be as low as 1 picoliter while others may be 8 to 10 picoliters. In the discussion of flow rate calculation above, the exemplary nominal value of drop volume for nozzle array 120 is 6 picoliters, while the exemplary nominal value of drop volume for nozzle array 130 is 3 picoliters. In particular, the data of FIG. 11 suggests that an increase of printhead die temperature of approximately 25° C.×(0.25/0.7)~9° C. would be sufficient to compensate the drop volume for a negative pressure change between −2 and −10 inches of water. U.S. Pat. No. 4,791,435 and U.S. Pat. No. 5,107,276 disclose methods of increasing the temperature of the printhead die 251. For a thermal ink jet printhead, the drop ejector corresponding to each nozzle includes a resistive heater that vaporizes ink near the heater when the heater resistor is provided with a pulse of sufficient energy, such that as the vapor bubble grows, it propels an ink droplet out of the nozzle. If, however, an energy pulse is insufficient to form a bubble (i.e. the pulsewidth and/or the voltage of the pulse are subthreshold), the energy will instead heat the printhead die and the ink residing within it. For example, if an acceptable operating range for the printhead die 251 has been determined to be 15° C. to 50° C., the prior art approach would be to use many subthreshold pulses from many heaters on the printhead die to warm the die if its temperature was measured to be less than 15° C. Alternatively, auxiliary heaters other than those for drop ejection may be provided on the printhead die 251 in order to warm up the die as needed. The amount of warming to be provided through subthreshold pulses to the drop ejector heaters or through energy applied to auxiliary heaters may be monitored via the temperature sensor 2000 on the printhead die or may be calculated based on the initial temperature of the printhead die.

In an embodiment of the present invention, the amount of warming to be provided is a function not only of the initial temperature of the printhead die as measured by sensor 2000, but also of parameters related to the negative pressure of an ink tank chamber, such as the amount of ink remaining in the tank chamber (sensor 1000) and/or the ink demand anticipated for the image to be printed. Therefore, based upon signals received by controller 14, auxiliary heater 2002 schematically shown in FIG. 1 (or drop ejector heaters for the case of a thermal inkjet printhead) can be enabled to warm up the die as needed. For example, for a nozzle array corresponding to an ink tank chamber that is nearly full and for low ink demand for the image to be printed, the lower limit of the operating range could be extended to 13° C. and supplemental heating would only be provided at temperatures lower than that. However, for a nozzle array corresponding to an ink tank chamber that is nearly empty and for high ink demand for the image to be printed, supplemental heating would be provided until the printhead die temperature reaches a lower limit temperature of 22° C., for example. For a thermal inkjet printhead, the temperature of the printhead die 251 tends to be raised during printing, due to thermal energy from the drop ejectors that goes into the die substrate 111. It may be that supplemental heating for a partially depleted tank chamber is only required for an initial print or a few initial prints after a period of non printing in a relatively cool printing environment. The upper limit of the operating temperature range of the printhead die can also be adjusted as needed based on parameters relating to the negative pressure provided by the ink tank chamber.

Heating the printhead die is one example of heating a portion of a printhead. Other examples include heating the ink in the ink reservoir or in the passageways between the ink reservoir and the printhead die.

A second known way of adjusting drop ejecting conditions besides the aforementioned supplemental heating of a portion of the printhead, is to adjust the pulse train or pulse waveform provided to a particular heater immediately prior to its providing energy for drop ejection. U.S. Pat. No. 4,490,728 discloses that by pulsing a drop ejector resistor of a thermal inkjet printhead with a two-part electrical pulse (a precursor pulse and a nucleation pulse), the precursor pulse can preheat the ink in the vicinity of the heater resistor to a temperature below the bubble nucleation temperature. The subsequent nucleation pulse heats the ink near the heater resistor to approximately the superheat limit of the ink so that a bubble nucleates. The maximum size of the bubble, and hence the size of the droplet that is ejected, depends upon the volume of ink that has been heated by the precursor pulse. U.S. Pat. No. 4,490,728 discloses using different pulse amplitudes and different pulse shapes for the precursor pulse and the nucleation pulse. U.S. Pat. No. 5,036,337 discloses providing multiple precursor pulses prior to the nucleation pulse, and varying the number of pulses, or widths of pulses or idle time between pulses in order to keep the drop volume constant in spite of variation in printhead temperature, manufacturing tolerance or number of heating elements that are simultaneously fired.

It is found that the amount of range of drop volume change that can be provided using one or more precursor pulses with a nucleation pulse is sufficient to keep the drop volume substantially constant even though the printhead die temperature is varied by about 35° C. (e.g. from 15° C. to 50° C.). For example, a look-up table associated with controller 14 can be provided to change the precursor pulse width, the time between pulses, the nucleation pulse width, and the pulse voltage as a function of printhead die temperature and thereby keep the drop volume substantially constant, even though it might vary by 10% to 15% if the pulses are not adjusted as a function of temperature. If the printhead die temperature exceeds 50° C. by up to a few degrees, drop volume increases in uncompensated fashion, and a printhead die upper temperature limit of operation can be specified as 55° C., for example. In an embodiment of the present invention, the varying of the pulses (including pulse width, pulse spacing, pulse amplitude, and/or the number of pulses) is dependent on not only the printhead die temperature, but also on parameters relating to negative pressure of an ink tank chamber, such as the amount of ink remaining in the tank chamber and/or the ink demand anticipated for the image to be printed. At low temperatures and for conditions providing large negative pressure, a pulse train having wider precursor pulse(s) for example can be used, while at higher temperatures and for conditions providing lower negative pressure, a pulse train having narrower precursor pulse(s) or fewer precursor pulses can be used.

It is preferable to have as wide a temperature operating range for the printhead as possible, both to allow printing over a range of ambient temperatures (as might be encountered in homes or offices in different parts of the world at different times) and also to accommodate the self-heating of a thermal inkjet printhead during operation. By using both supplemental heating to raise the temperature of the printhead die at low temperatures and low ink fill and/or high ink demand, and also adjusting the pulse train as a function of both temperature and the parameters relating to negative pressure, a wide temperature range of operation can be maintained.

In the example described above, for keeping drop volume constant as a function only of temperature, if the printhead die temperature was found to be below 15° C., it would be heated first to 15° C. Then precursor pulses would be used to keep drop volume approximately constant over an operating temperature range of 15° C. to 50° C. The printhead would be allowed to operate above 50° C. without controlling drop volume up to an upper limit temperature of about 55° C., at which point printing needs to be slowed down to keep the printhead die from overheating.

In an embodiment of the present invention for keeping drop volume substantially constant as a function of both temperature and negative pressure, the method is modified such that the operating temperature range is shifted to a lower temperature range for a nearly full tank and shifted to a higher temperature range for a nearly empty tank. In the discussion of FIG. 11 it was indicated that a temperature difference of about 9° C. could compensate for the negative pressure differences between a nearly fill tank and a nearly empty tank. In one example, for a nearly full ink tank and/or for low ink demand, the printhead die temperature would be raised by supplemental heating until it reached a temperature of about 13° C. (i.e. 2° C. below the 15° C. lower point of the operating temperature range noted above), and pulse train adjustments would be used to provide a substantially constant drop volume over a 35° C. range up to 48° C. Above 48° C. the drop volume would be allowed to increase until the upper limit die temperature (for example, about 53° C.) is exceeded, at which point printing throughput can be slowed down to allow cooling of the printhead die. In the same example, for a nearly empty tank and/or for high ink demand, the printhead die temperature would be raised to 22° C. (i.e. 7° C. higher than the 15° C. lower point of the operating range, and 9° C. higher than the lower point of the operating range in this example for a nearly full tank) by supplemental heating, and pulse train adjustments would be used to provide a substantially constant drop volume over a 35° C. range up to 57° C. Above 57° C. the drop volume would be allowed to increase until an upper limit die temperature (for example, about 62° C.) is exceeded, at which point printing throughput can be slowed down to allow cooling of the printhead die. The upper limit die temperature is dependant on the ejector design and is governed by the stability of the meniscus, air bubble formation within the ejector chamber, and stability of the ink's physical properties, so in some embodiments the upper limit die temperature might not be shifted by the same amount as the operating temperature range. The pulse train settings used for a nozzle array corresponding to an ink tank chamber providing a large amount of negative pressure at a temperature T1 can be similar to the pulse train settings used for the same nozzle array at a lower temperature T2 when the ink tank chamber provides a lesser amount of negative pressure.

The invention has been described in detail with particular reference to certain preferred embodiments thereof, but it will be understood that variations and modifications can be effected within the spirit and scope of the invention.

The invention claimed is:

1. A method of printing comprising:

providing a printhead providing an ink tank including an ink chamber in fluid communication with the printhead, the ink chamber comprising:

ink;

a porous capillary medium for providing a negative pressure on the ink in the printhead;

monitoring a quantity of ink remaining in the ink chamber; and without reducing printing throughput, adjusting an ink drop ejecting condition of the printhead as a function of the quantity of ink remaining in the ink chamber so that an amount of variation in size of an ejected ink drop is reduced.

2. The method of claim 1, wherein the step of monitoring the quantity of ink remaining in the ink chamber comprises using a sensor to directly monitor the amount of ink remaining in the ink chamber.

3. The method of claim 2, wherein the sensor is an optical sensor.

4. The method of claim 2 wherein the sensor is an electrically resistive sensor.

5. The method of claim 2, wherein the sensor is a capacitive sensor.

6. The method of claim 2, wherein the sensor is a mechanical sensor.

7. The method of claim 1, wherein the step of monitoring the quantity of ink remaining in the ink chamber comprises:

starting with a known amount of ink in the chamber;

counting the drops used in printing and multiplying by the volume per drop to provide a volume used by printing;

subtracting the volume used by printing from the known amount to provide a new known amount of ink in the chamber;

counting the number of maintenance operations and multiplying by the volume used per maintenance operation to provide a volume used by maintenance; and subtracting the volume used by maintenance to provide an updated known amount of ink in the chamber.

8. The method of claim 1, wherein the step of adjusting the ink drop ejecting conditions of the printhead comprises heating a portion of the printhead.

9. The method of claim 8, wherein said heating of the portion of the printhead comprises heating the printhead until a printhead die of the printhead reaches a lower limit temperature, wherein the lower limit temperature depends upon an ink amount remaining in the ink chamber.

10. The method of claim 8, wherein said heating of the portion of the printhead comprises heating the printhead until a printhead die of the printhead reaches a lower limit temperature, wherein the lower limit temperature depends upon an ink demand required to print an image or a portion of an image.

11. The method of claim 1, wherein the step of adjusting the ink drop ejecting conditions of the printhead comprises adjusting a pulse train applied to the drop ejector.

12. The method of claim 1, wherein the step of adjusting the ink drop ejecting conditions of the printhead comprises adjusting a voltage waveform applied to the drop ejector.

* * * * *